US005588164A

United States Patent [19]

Proulx

[11] Patent Number: 5,588,164

[45] Date of Patent: Dec. 31, 1996

[54] INFANT SEAT ROCKER AND AMUSEMENT UNIT

[76] Inventor: Genevieve C. Proulx, 1475 Waltham Street, Gloucester, Ontario, Canada, K1T 2T5

[21] Appl. No.: 517,848

[22] Filed: Aug. 22, 1995

[51] Int. Cl.[6] ..... A47C 3/02; A47D 9/02; A47D 13/10; A63H 18/08

[52] U.S. Cl. ..... 5/109; 297/260.2; 446/396; 446/444; 601/84; 601/90

[58] Field of Search ..... 5/105, 106, 107, 5/108, 109, 658, 101; 446/170, 227, 396, 445, 444; 297/130, 133, 258.1, 260.2; 601/49, 53, 86, 89, 90

[56] References Cited

U.S. PATENT DOCUMENTS

| | | | |
|---|---|---|---|
| D. 142,512 | 10/1945 | Cronk | 297/133 |
| 1,537,547 | 5/1925 | Perkins | 446/444 |
| 3,653,080 | 4/1972 | Hafele . | |
| 3,851,343 | 12/1974 | Kinslow, Jr. . | |
| 4,084,273 | 4/1978 | Haynes | 5/105 |
| 4,123,078 | 10/1978 | Murakami | 446/227 |
| 4,371,206 | 2/1983 | Johnson, Jr. . | |
| 4,656,680 | 4/1987 | Wilson . | |
| 4,911,499 | 3/1990 | Meeker . | |
| 4,985,949 | 1/1991 | Jantz . | |
| 5,294,172 | 3/1994 | Dubus | 446/227 |

*Primary Examiner*—Steven N. Meyers
*Assistant Examiner*—Robert G. Santas
*Attorney, Agent, or Firm*—Stanley E. Johnson

[57] ABSTRACT

A base unit for supporting an infant carrier seat comprising a housing member having a bottom curved surface for rocking on a generally flat support surface, an upper central portion on which an infant carrier seat is removably mountable, an endless pathway that circumscribes said central portion, a weight and a motor to move along the weight in a closed loop at a selected predetermined rate of travel. The weight in the preferred form is a toy train unit with open topped box cars that removably hold a supply of weights. A sound generator on the train provides music and/or train whistle simulation. An infant can be entertained by the train travelling around the infant, by sounds generated by the train and the infant is rocked, all at the same time. The motion of the train travelling around the infant can be used to check responses of the infant as can also the movement of sound relative to the infant.

11 Claims, 7 Drawing Sheets

INFANT SEAT ROCKER AND AMUSEMENT UNIT

FIELD OF THE INVENTION

This invention relates generally to infant seat rockers and more particularly to a unit caused to rock by a viewable moving weight. The unit provides a rocking base for an infant seat as well as an amusement device.

BACKGROUND OF INVENTION

Baby carriers, car seats and infant seat power rockers are known. Infant seats with power means to cause them to oscillate about an axis located in a fixed position are disclosed in U.S. Pat. Nos. 3,653,080 and 3,851,343 issued, respectively, Apr. 4, 1972 and Dec. 3, 1974.

A rockable infant seat carrier is disclosed in U.S. Pat. No. 4,371,206 issued Feb. 1, 1983 and means for rocking such type of seat is disclosed in U.S. Pat. No. 4,985,949 issued Jan. 22, 1991.

Bases for supporting an infant carrier seat are disclosed in U.S. Pat. Nos. 4,656,680 and 4,911,499 issued, respectively, Apr. 14, 1987 and Mar. 27, 1990. In each instance, the base incorporates therein means to cause movement of the seat. In U.S. Pat. No. 4,656,680, the infant carrier is raised and lowered about a pivot axis fixed in position and in U.S. Pat. No. 4,911,499 the base swings back and forth.

A swinging or oscillating movement (i.e. pivoting about an axis disposed in a fixed location) is quite a different motion for a body to be subjected to than is that from a rocking movement. Old and young alike seem to derive relaxation as a result of being subjected to a rocking action which involves a moving pivot axis.

SUMMARY OF THE INVENTION

An object of the present invention is to provide a base unit, for an infant carrier, car seat or the like, that has a bottom curved surface for rocking on a supporting surface and a weight on the unit moved by suitable power to shift from one position to another at a selected rate to cause the base unit (with an infant seat and infant thereon) to rock.

A further object is provide a base unit of the foregoing type wherein the weight travels around an infant in a seat resting on such base unit.

A further principle object of the present invention is to provide a base unit for supporting an infant carrier seat wherein the base unit includes so to speak motion, sight and sound. The motion is rocking, as well as movement of a toy train and the train is observable and generates sound as it travels in a closed loop path around an infant in a carrier seat on the base.

In keeping with the foregoing objects, there is provided in accordance with the present invention a base unit for supporting an infant carrier seat comprising a housing member having a bottom curved surface for rocking on a generally flat support surface, an upper central portion on which an infant carrier seat is removably mountable, an endless pathway that circumscribes said central portion, a weight and means to cause said weight to move along said path in a closed loop at a selected predetermined rate of travel.

The weight in the preferred form is a toy train unit with open topped box cars that removable hold a supply of weights (bags of marbles or the like). Sound generating means (music and/or train whistle simulation) can also be mounted on the train unit.

LIST OF DRAWINGS

The invention is illustrated by way of example in the accompanying drawings wherein.

DESCRIPTION OF PREFERRED EMBODIMENT

Figure 1:
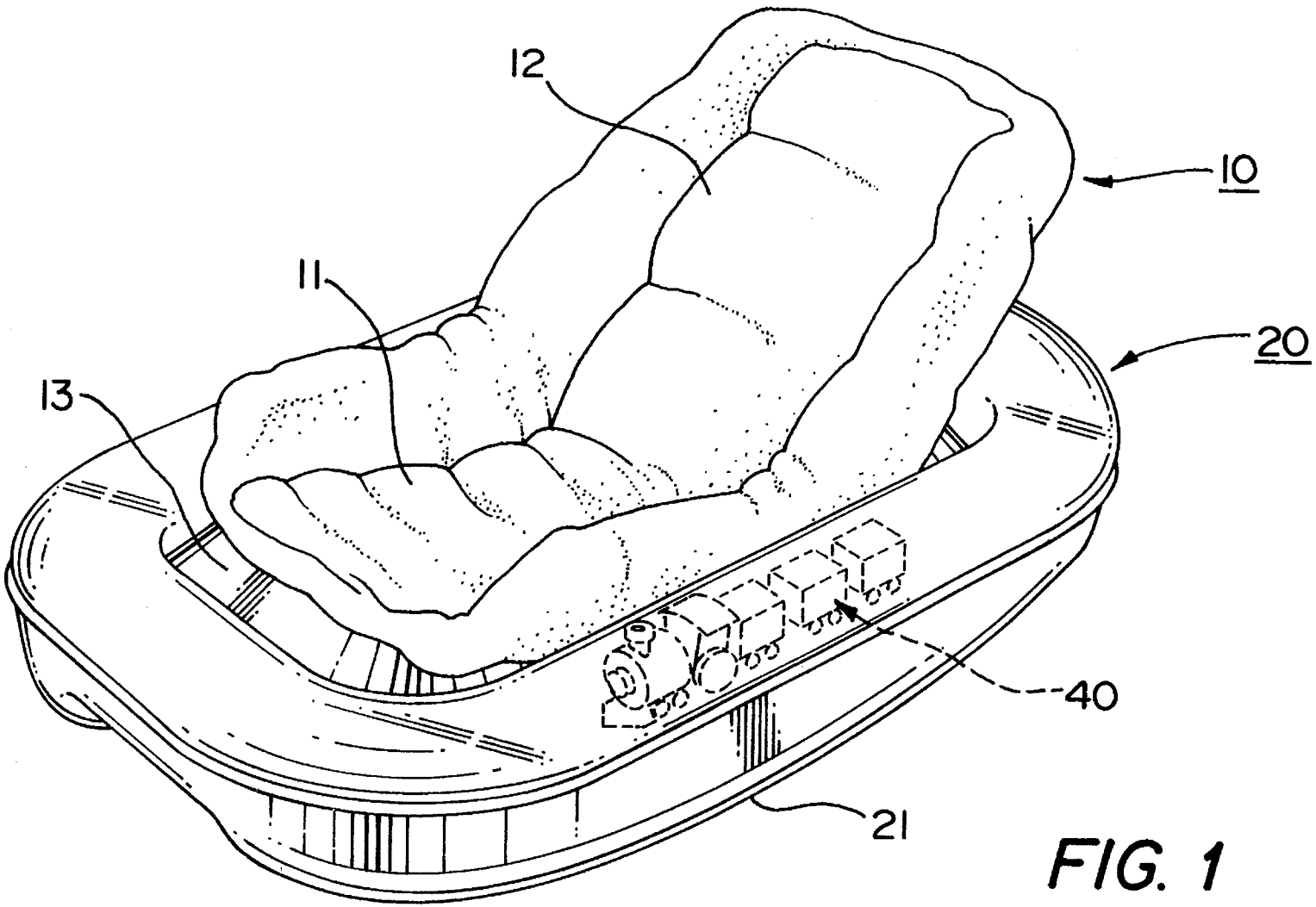
FIG. 1 is an oblique view of a base unit of the present invention with an infant seat thereon.
Figure 2:
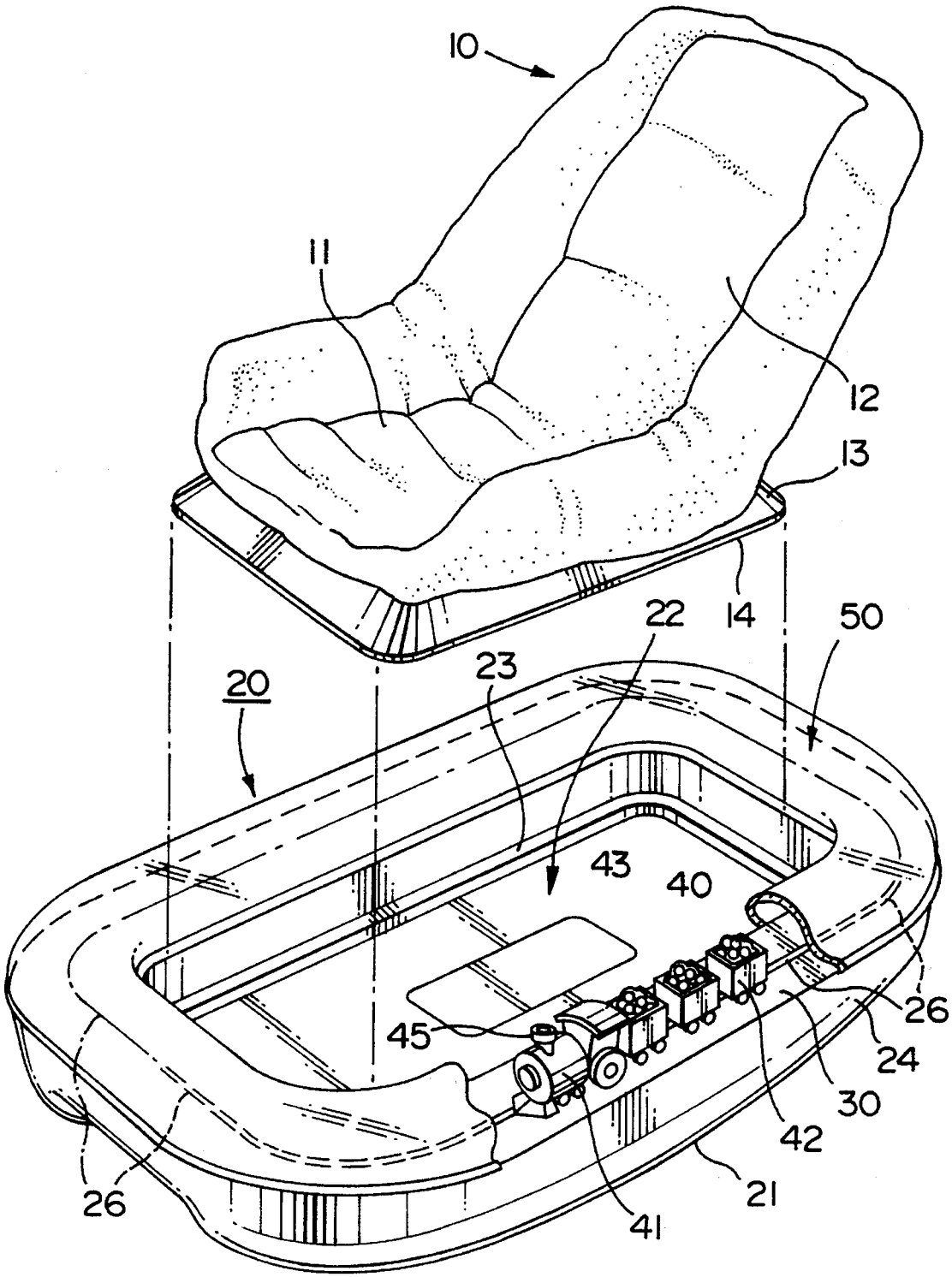
FIG. 2 is an exploded view of FIG. 1 with a portion of the base unit broken away.

Referring to the drawings, there is illustrated in FIGS. 1 and 2 an infant carrier seat (or car seat) 10 and a rockable base unit 20.

The seat 10 may be of any conventional car seat or infant carrier seat. Illustrated is a cushioned integral seat 11 and back rest 12 on a base 13. The base has a lower edge 14 which may be straight as shown or curved on the longitudinal edges as, for example, the infant carrier illustrated in the aforementioned U.S. Pat. No. 4,371,206. The lower edge 14 rests on a ledge on the base unit 20 to be described hereinafter. Obviously such ledge can be made to accommodate variously shaped bottom edges of an infant's carrier seat and in place of a ledge pins could be used.

The base unit 20 has a double pontoon like bottom in which the lower outer edges 21 are curved front to back so that the unit can rock. There is a central cavity 22 for receiving the infant carrier 10 and a ledge 23 for supporting such seat. Surrounding the cavity 22 is a closed loop or endless pathway 30 on which a toy train unit 40 travels and this pathway and train unit are covered over by a transparent cover 50. The pathway and cover constitute a tunnel for the train unit and the latter is viewable as it moves. If desired, selected areas of the cover may be non-transparent so that the train unit is viewable only at selected portions of the train's travel.

The train unit 40 has a locomotive 41, drawn around the trackway in a manner to be described hereinafter, towing therebehind open topped box cars 42. The box cars carry weights 43, for example, bags of coloured marbles, which may be added to or taken away from as desired. The weights might also be a plurality of blocks, spheres or the like detachably, or adhesively, joined together and secured to a base that fits into the cavity of the open topped box car. The train unit 40 can, if desired, include a sound generating unit 45 (also in this case simulates the smoke stack of a steam locomotive) that may simulate a train's whistle or produce a desired tune (i.e. music). The cars 42 (or wagons as they may also be referred to) are preferably detachably interconnected so they can be added to or taken from the string of them (i.e. train) as may be desired.

The moving train unit is a moving weight that changes the center of gravity of the base unit causing the latter to rock back and forth. The frequency of rocking will depend upon the speed of travel of the train (which can be varied) and the amplitude of rocking will depend upon the weight of the train unit (which can also be varied by adding to or taking away weights from the box cars and/or varying the number of box cars of the train).

From the foregoing, it will be realized that an infant can be entertained by the train travelling around the infant, by sounds generated by the train, and be rocked all at the same time. The motion of the train travelling around the infant can be used to check responses of the infant as can also the movement of sound relative to the infant. The rocking and/or sounds can also be used to sooth an irritated infant. Colours of the seat 10, base 20, train unit 40 and weights 43 can be co-ordinated and chosen to suit various individuals and provide an attractive unit for an infant.

Figure 6:
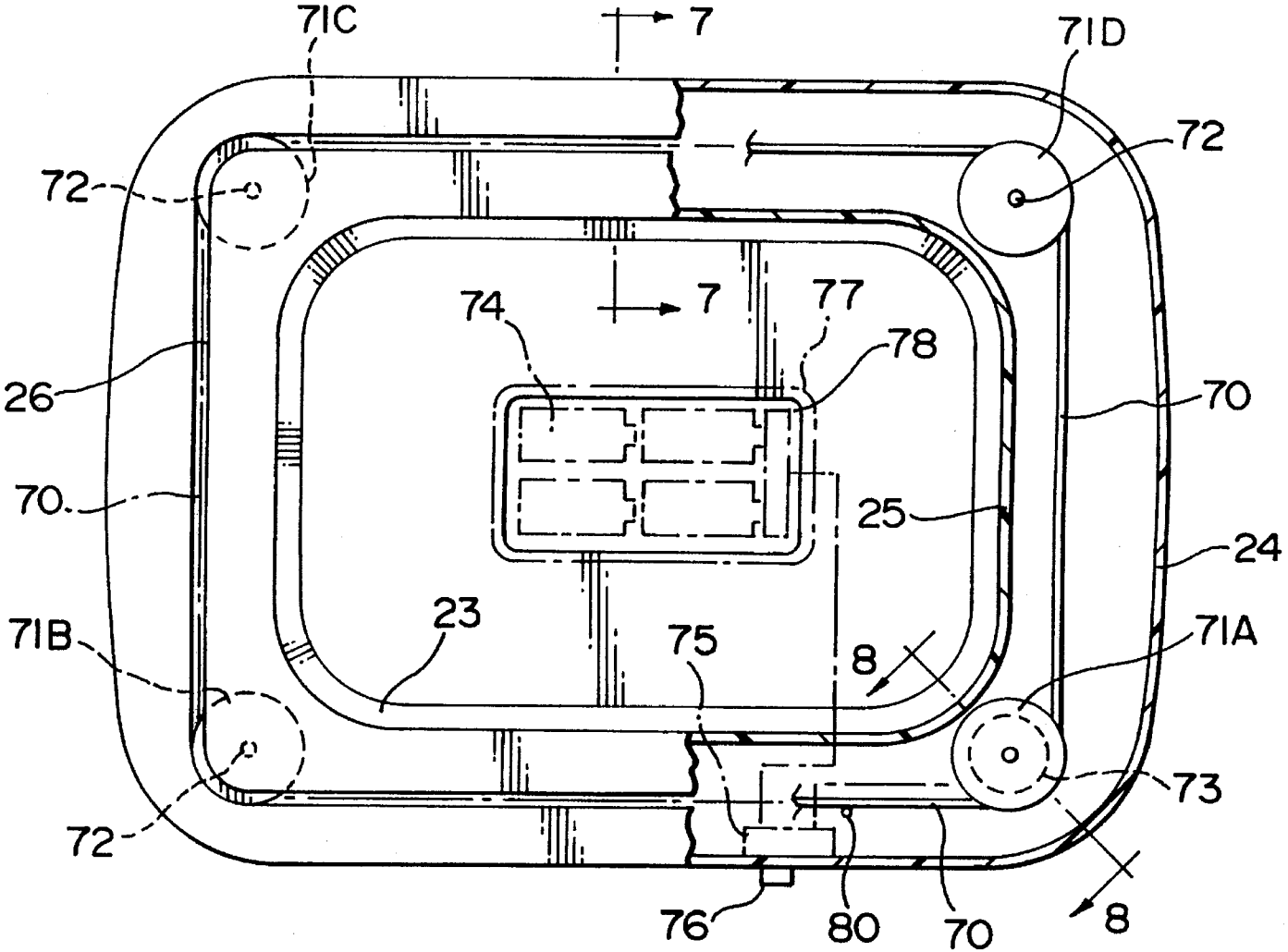
FIG. 6 is a top plan view of the infant seat base unit of the present invention with portions in section and the transparent cover removed.
Figure 8:
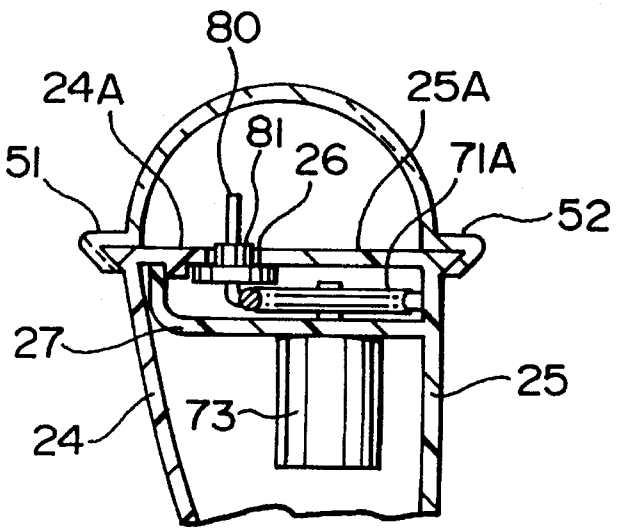
FIG. 8 is a sectional view taken essentially along line 8—8 of FIG. 6.
Figure 7:
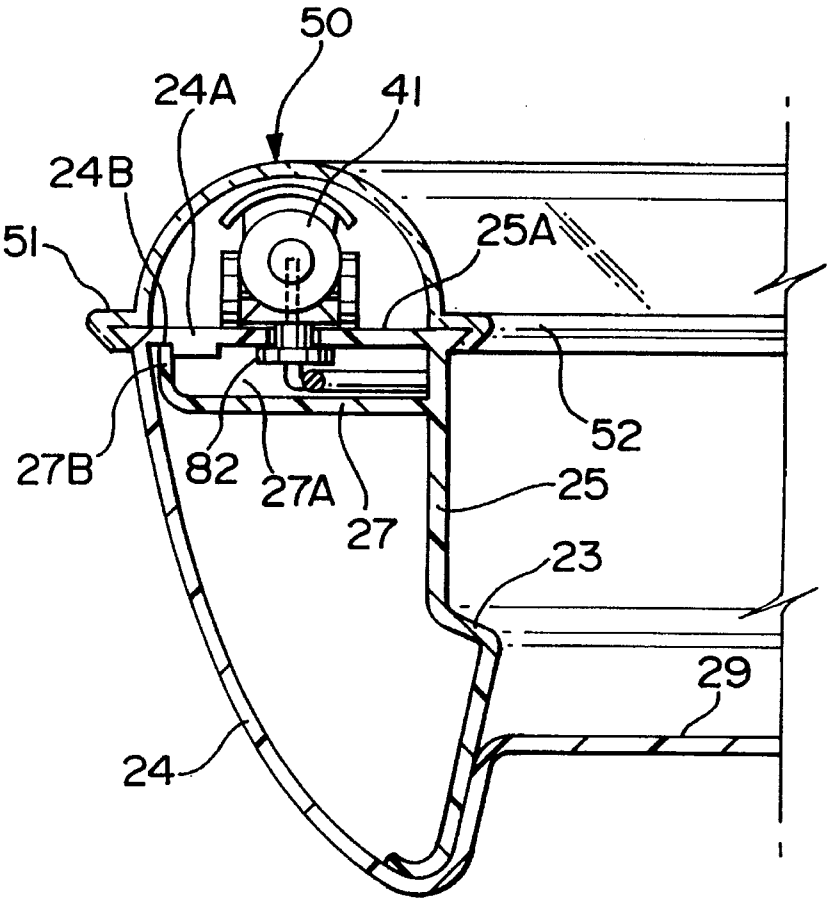
FIG. 7 is a sectional view taken along line 7—7 of FIG. 6 but including the locomotive portion of the train set.

Referring to FIGS. 6, 7 and 8, the base unit 20 includes an outer shell 24 and an inner shell 25 with respective flanges 24A and 25A directed inwardly toward one another and spaced apart providing a gap 26 therebetween.

The flanges 24A and 25A provide the aforementioned pathway 30 and gap 26 provides means for guiding the toy train unit in a closed loop path. The inner shell 25 has a further flange 27 spaced below flanges 24A and 25A that provides a guide way 27A below the train unit. Flange 27 has an upwardly turned end portion 27B that snap fits into a groove 24B in the bottom face of flange 24A.

The train unit is towed around the endless pathway by a power system that includes an endless cable 70 running on idler pulleys 71B, 71C and 71D journalled on pins 72 projecting upwardly from flange 27 and motor driven pulley 71A. A motor 73, drivingly connected to pulley 71A, is powered by batteries 74 through a rheostat switch 75 (or similar variable speed control). Switch 75 is shown in FIG. 6 as having a finger grip adjusting knob 76 on the outer sidewall surface of the base outer shell 24. The batteries 74 are located in a battery box 77 located in the floor 29 of the outer shell. A removable cover 78 provides access to the battery box for replacement of the batteries.

The endless cable 70 (belt, chain or the like) has a pin 80 secured thereto on a side thereof remote from the pulleys. Also the groove in the pulley for the cable is shallow so that the pulley wont interfere with the pin or alternatively the pin may be "L" shaped. The pin 80 has a sleeve 81 that runs in the gap 26 and secured to the pin is a washer or the like element 82 that spans the gap below flanges 24A and 25A. This keeps the sleeve bearing 81 in position. The pin 80 press fits into a hole in the bottom of the locomotive 41.

The cars 42 of the train unit are connected to the locomotive and towed thereby. If desired a pin 80 may be provided for each of the cars in which case the cars need not be connected directly one to the other.

The transparent cover (or dome) 50 may be a single section unit, or multiple sections, that snap fits by suitable means such as outer and inner respective channels 51 and 52 onto ribs on the respective outer and inner shells 24 and 25.

The inner and outer shells 24 and 25 and cover 50 are made of plastics material and moulded or suitably heat formed to shape.

Figure 9:
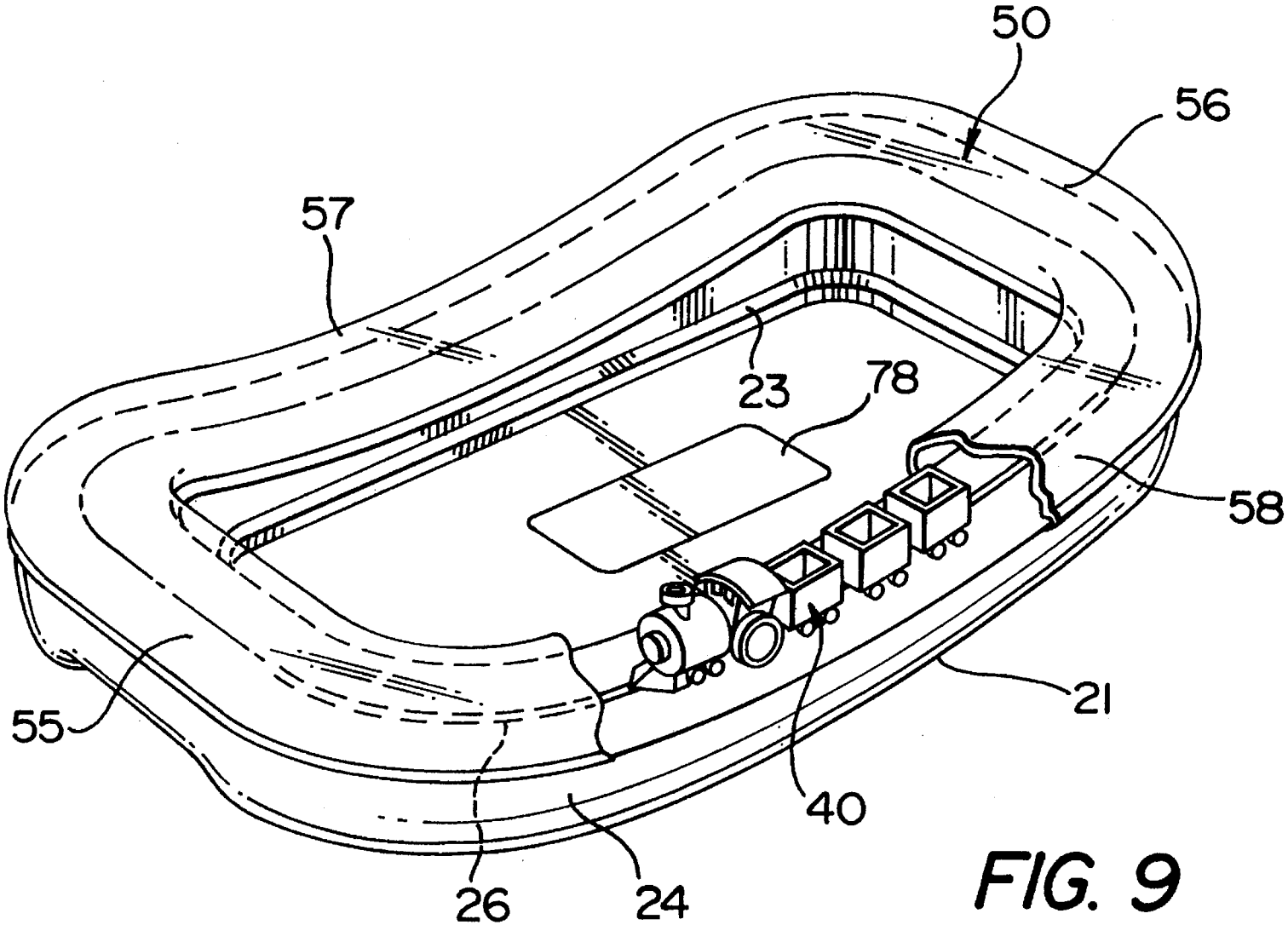
FIG. 9 is an oblique view similar to FIG. 2, but of the base unit only and illustrating an undulating path for the train set.

FIG. 9 illustrates a cover 50 and corresponding pathway where the respective front and rear portions 55 and 56 are raised relative to the respective opposite longitudinal side portions 57 and 58. This is intended to illustrate an embodiment of where the train passageway undulates up and down around the closed loop path.

Figure 3:
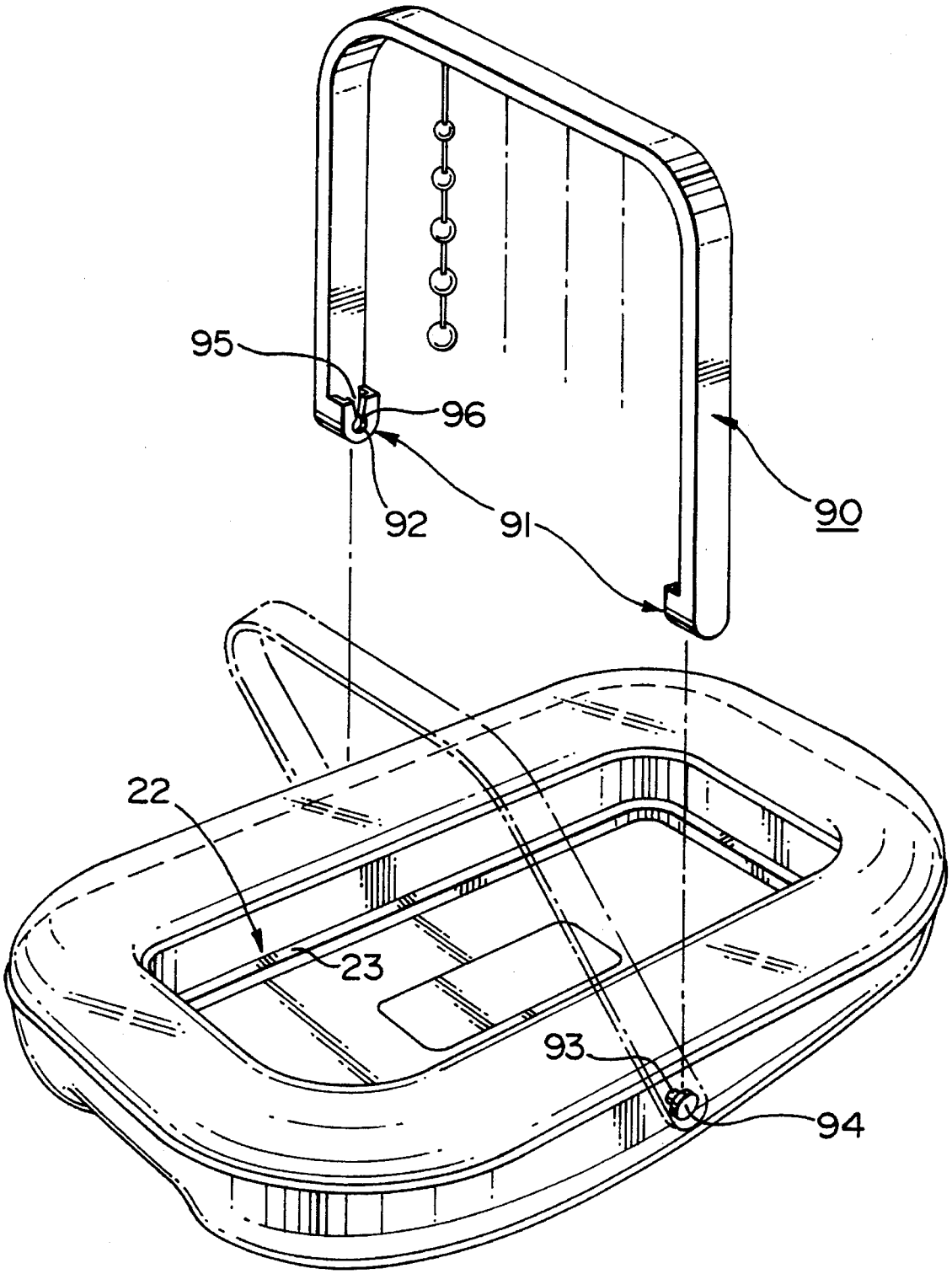
FIG. 3 is an oblique view of the base unit only with an optional detachable handle.
Figure 4:
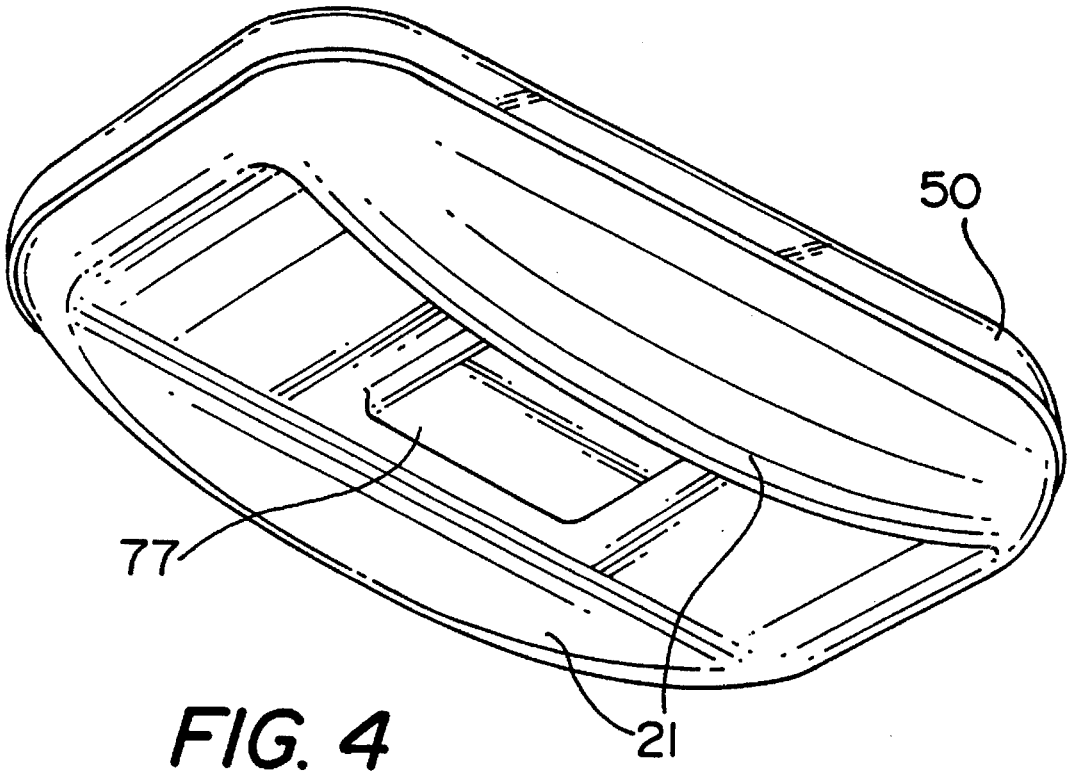
FIG. 4 is an oblique view of the bottom of the base unit shown in FIGS. 1 to 3.
Figure 5:
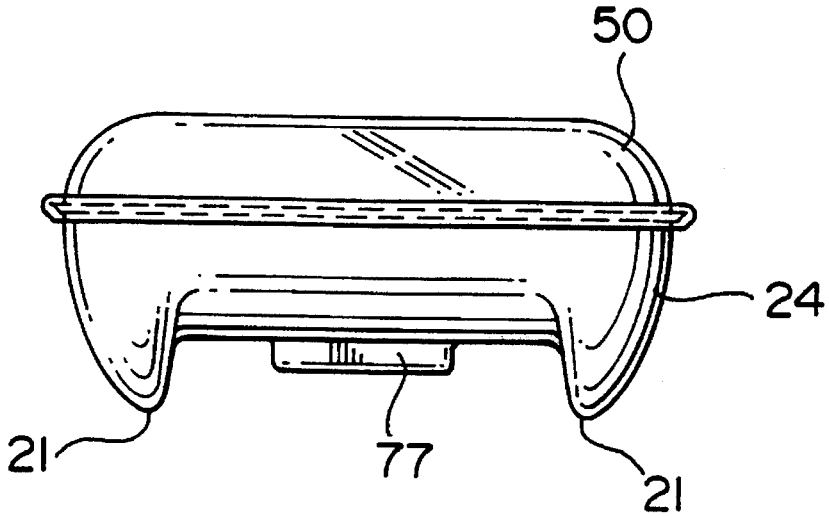
FIG. 5 is a front view of FIG. 4.

The base unit 20, as shown in FIG. 3, may be provided with a detachable carrying handle 90. Referring to FIG. 3, the handle 90 has a pair of sockets 91 each with an opening 92 to receive a pin 93 projecting from the outer sidewalls of the base unit. Each pin 93 has a head 94 that slides into a channel 95 and a neck 96, narrower than the pin 93, retains the handle on the pin. Plastics materials may be chosen by those skilled in the art to provide a suitable releasable snap press fit relation and suitable plastics materials may be chosen for the inner and outer housings.

The motor 73, while disclosed as power operated, could obviously be a wind-up spring motor controlled in speed by a suitable gear train drive as is well known in mechanical motors.

I claim:

1. A base unit for supporting an infant carrier seat comprising a housing having a curved bottom surface for rocking on a generally flat support surface, said housing having an upper central portion on which an infant carrier seat is removably mountable, an endless closed loop pathway circumscribing said central portion, a weight, and power means to move said weight along said path in a closed loop at a selected rate of speed to cause said base unit to rock.

2. A base unit as defined in claim 1, wherein said central portion constitutes a cavity in said housing.

3. A base unit as defined in claim 1, including a cover over said pathway providing a channel for said weight.

4. A base unit as defined in claim 3, wherein at least selected areas of said cover along the path of travel of said weight are transparent for viewing the weight as it moves.

5. A base unit as defined in claim 4, wherein said weight is a toy train.

6. A base unit as defined in claim 5, wherein said toy train carries therewith means for generating predetermined selected sounds.

7. A base unit as defined in claim 1, wherein said power means comprises an endless belt, chain, or cable guided to follow said closed loop pathway, motor means for causing said endless belt, chain, or cable to travel in said closed loop pathway and means connecting said train unit to a belt, chain, or cable.

8. A base unit as defined in claim 1, including a guide slot in said closed loop pathway, wherein said weight comprises a toy train and wherein said train is guided around said closed loop pathway by said guide slot.

9. A base unit as defined in claim 8, wherein said toy train includes a locomotive and cars and wherein said cars carry removable weights.

10. A base unit as defined in claim 9, including a dome like transparent cover, ovoid in plan view, detachably mounted on said housing and overlying said closed loop pathway providing a tunnel passageway for the toy train.

11. A base unit as defined in claim 10, wherein said pathway undulates up and down around said closed loop.

* * * * *